US006874477B1

(12) United States Patent
Lorraine et al.

(10) Patent No.: US 6,874,477 B1
(45) Date of Patent: Apr. 5, 2005

(54) FUEL INJECTOR MOUNTING ARRANGEMENT

(75) Inventors: Jack Richardson Lorraine, Newport News, VA (US); Todd Matthew Answine, Newport News, VA (US); Dean Leigh Spiers, Yorktown, VA (US)

(73) Assignee: Siemens VDO Automotive Corp., Auburn Hills, MI (US)

( * ) Notice: Subject to any disclaimer, the term of this patent is extended or adjusted under 35 U.S.C. 154(b) by 0 days.

(21) Appl. No.: 09/313,407

(22) Filed: May 18, 1999

Related U.S. Application Data

(60) Provisional application No. 60/130,214, filed on Apr. 20, 1999.

(51) Int. Cl.[7] ..... F02M 37/04

(52) U.S. Cl. ..... 123/468; 123/456; 123/470; 73/119.19

(58) Field of Search ..... 193/470, 492, 193/98 D, 468, 469, 509, 456, 198 D; 73/119 A

(56) References Cited

U.S. PATENT DOCUMENTS 4,295,452 A * 10/1981 Lembke et al. ..... 123/470
4,307,693 A 12/1981 Glöckler et al.
5,035,224 A * 7/1991 Hornby et al. ..... 123/470
5,040,512 A * 8/1991 Twilton ..... 123/470
5,136,999 A * 8/1992 Bassler et al. ..... 123/470
5,146,896 A 9/1992 Imoehl et al.
5,718,205 A * 2/1998 Jo ..... 123/470
5,735,247 A * 4/1998 Tsuzuki et al. ..... 123/470
5,752,487 A * 5/1998 Harrell et al. ..... 123/470
5,893,351 A * 4/1999 Akutagawa et al. ..... 123/470
6,019,089 A * 2/2000 Taylor et al. ..... 123/470
6,053,149 A * 4/2000 Lorraine ..... 123/470

FOREIGN PATENT DOCUMENTS

EP 0 887 543 A2 12/1998

* cited by examiner

*Primary Examiner*—Carl S. Miller

(57) ABSTRACT

A mounting arrangement with a fuel rail having a plurality of fuel injector cups, a plurality of fuel injectors, and a clip. The fuel injector cups include a cylindrical tube defining a longitudinal axis, a fuel rail mounting section disposed at a first end of the tube, and a lip at a second end of the tube. Each of the fuel injectors corresponding to one of the plurality of fuel injector cups. The fuel injectors have a housing with a retention groove. The clip engages both the lip of the fuel injector cup and the retention groove in the housing of the fuel injector to secure the fuel injector to the fuel injector cup and allow the fuel injector to reciprocate along the longitudinal axis.

16 Claims, 3 Drawing Sheets

FUEL INJECTOR MOUNTING ARRANGEMENT

CROSS-REFERENCE TO RELATED APPLICATION

This application expressly claims the benefit of earlier filing date and right of priority from the following co-pending patent application: U.S. Provisional Application U.S. Ser. No. 60/130,214, entitled "Fuel Injector Mounting Arrangement" filed 20 Apr. 1999. The cited patent application is expressly incorporated in its entirety by reference.

BACKGROUND OF THE INVENTION

Particular fuel injection systems employ an air-assist system to encourage atomization of fuel that is metered out of a fuel injector into the air intake stream within an air induction device. In order to employ an air-assist system, the fuel injector needs to form operative seals with a plurality of structural members. In particular, the fuel injector needs to form at least one fuel seal and at least one atmosphere seal. The fuel seal being located between the fuel rail and the fuel injector. The atmosphere seal being located between the sub-atmospheric air in an air-assist passage of the air-assist system and the atmosphere air external to the air induction device.

A known manner of forming the atmosphere seal is to provide a face seal on the portion of the fuel injector installed in an aperture in the air induction device. The face seal engages and mates with a surface within the aperture to form the required atmosphere seal when an axial load is applied to the fuel injector. To apply the axial load, fuel pressure is applied to the fuel injector, which axial moves the fuel injector. In order to achieve this axial movement, fuel injectors in known systems are positioned proximate the fuel rail without being secured to the fuel rail.

SUMMARY OF THE INVENTION

Applicants have discovered that at least three primary problems result due to the non-secured arrangement of the fuel injector to the fuel rail. First, during production of the fuel rail and fuel injector assembly, an alternate method must be found to retain the injectors for pressure (leak) testing on the production.

Second, during shipping and handling, fuel injectors separate from the fuel rail, which creates contamination and decreases product integrity. Thus, additional packaging must be developed to avoid this problem. Third, during final installation of the fuel injector and fuel rail assembly into a vehicle, a method must be developed to provide rotational positioning of the fuel injector for correct spray pattern alignment and/or electrical connector alignment. The identified problems are obviated by applicants novel mounting arrangement.

The present invention provides a mounting arrangement having a fuel rail; a fuel injector cup connected to the fuel rail, the fuel injector cup having a fuel communication area defining a longitudinal axis, a fuel rail mounting section, and a retaining surface; a fuel injector including a fuel metering end and a fuel inlet end, the fuel inlet end being exposed to the communication area; and a fastener that secures the fuel injector to the fuel injector cup and allows the fuel injector to reciprocate along the longitudinal axis of the fuel injector cup.

The fuel injector cup, preferably, comprises a cylindrical tube with a fuel rail mounting section being located at a first end of the tube, and the retaining surface being located at a second end of the tube. The retaining surface, preferably, comprises a lip located at the second end of cylindrical tube extending away from the longitudinal axis. The fuel injector comprises a housing having a retention groove. The retention groove, preferably, comprises a channel that partially encircles the housing of the fuel injector. The fastener, preferably, comprises a clip having a wall and a pair of legs projecting from the wall. The pair of legs straddles both the fuel injector cup and the fuel injector. Each leg has a tab and a window. The tab has a mating surface that engages the channel of the fuel injector housing.

The mounting arrangement of the present invention also includes an air induction device having an aperture. The metering end of the fuel injector has a face seal that mates with the aperture when the fuel injector is located at one of the first position and the second position along the longitudinal axis.

The mounting arrangement of the present invention, preferably, comprises a production assembly having the clip installed by an automated process. The production assembly is capable of satisfying at least an appropriate assembly integrity test and environmental vibration test.

The present invention also provides a mounting arrangement with a fuel rail; a plurality of fuel injector cups connected to the fuel rail, each of the fuel injector cups including a cylindrical tube defining a longitudinal axis, a fuel rail mounting section disposed at a first end of the tube, and a lip at a second end of the tube; a plurality of fuel injectors, each fuel injector corresponding to one of the plurality of fuel injector cups, each fuel injector having a housing including a fuel metering end, a fuel inlet end, and a retention groove, the fuel inlet end of the fuel injector being disposed within the cylindrical tube of the fuel injection cup; and a clip that engages both the lip of the fuel injector cup and the retention groove in the housing of the fuel injector to secure the fuel injector to the fuel injector cup and allow the fuel injector to reciprocate along the longitudinal axis extending through the cylindrical tube of the fuel injector cup.

The present invention also provides a clip that secures a fuel injector to a fuel injector cup on a fuel rail. The clip comprises a wall having a first end and a second end; a first leg projecting from the first end of the wall, the first leg including a first tab and a first window; and a second leg projecting from the second end of the wall, the first leg and the second leg being substantially parallel, the second leg including a second tab and a second window.

The first tab and the second tab of the clip have a corresponding mating surface configuration adapted to engage the retention groove in a housing of the fuel injector. The first window and the second window of the clip, each have a substantially similar frame adapted to engage a lip of the fuel injector cup. Each of the frames has a pair of landing edges extending along the corresponding leg. The pair of landing edges on each of the frames is spaced so that engagement of one of the landing edges with the lip of the fuel injector cup is exclusive of engagement of the lip of the fuel injector cup with the other of the landing edges.

The present invention also provides a method of mounting a fuel injector to a fuel injector cup on a fuel rail so that the fuel injector is secured to the fuel injector cup and the fuel injector can be positioned along a longitudinal axis defined by the fuel injector cup. The method comprises: providing a fuel rail with at least one fuel injector cup, the at least one fuel injector cup including a retaining surface; locating at least one fuel injector proximate the at least one fuel injector cup, the at least one fuel injector having a housing with a retention groove; and securing the at least one fuel injector to the at least one fuel injector cup with a fastener that engages both the retention surface of the fuel injector cup and the retention groove in the housing of the fuel injector.

The method of the present invention also includes installing the clip with an automated process so that the at least one fuel rail, the at least one fuel injector, and the clip comprise a production assembly capable of satisfying at least an appropriate assembly integrity test and environmental vibration test.

DESCRIPTION OF THE DRAWING FIGURES

The accompanying drawings, which are incorporated herein and constitute part of this specification, illustrate presently preferred embodiments of the invention, and, together with a general description given above and the detailed description of the preferred embodiments given below, serve to explain the principles of the invention.

DETAILED DESCRIPTION OF THE PREFERRED EMBODIMENT(S)

Figure 1:
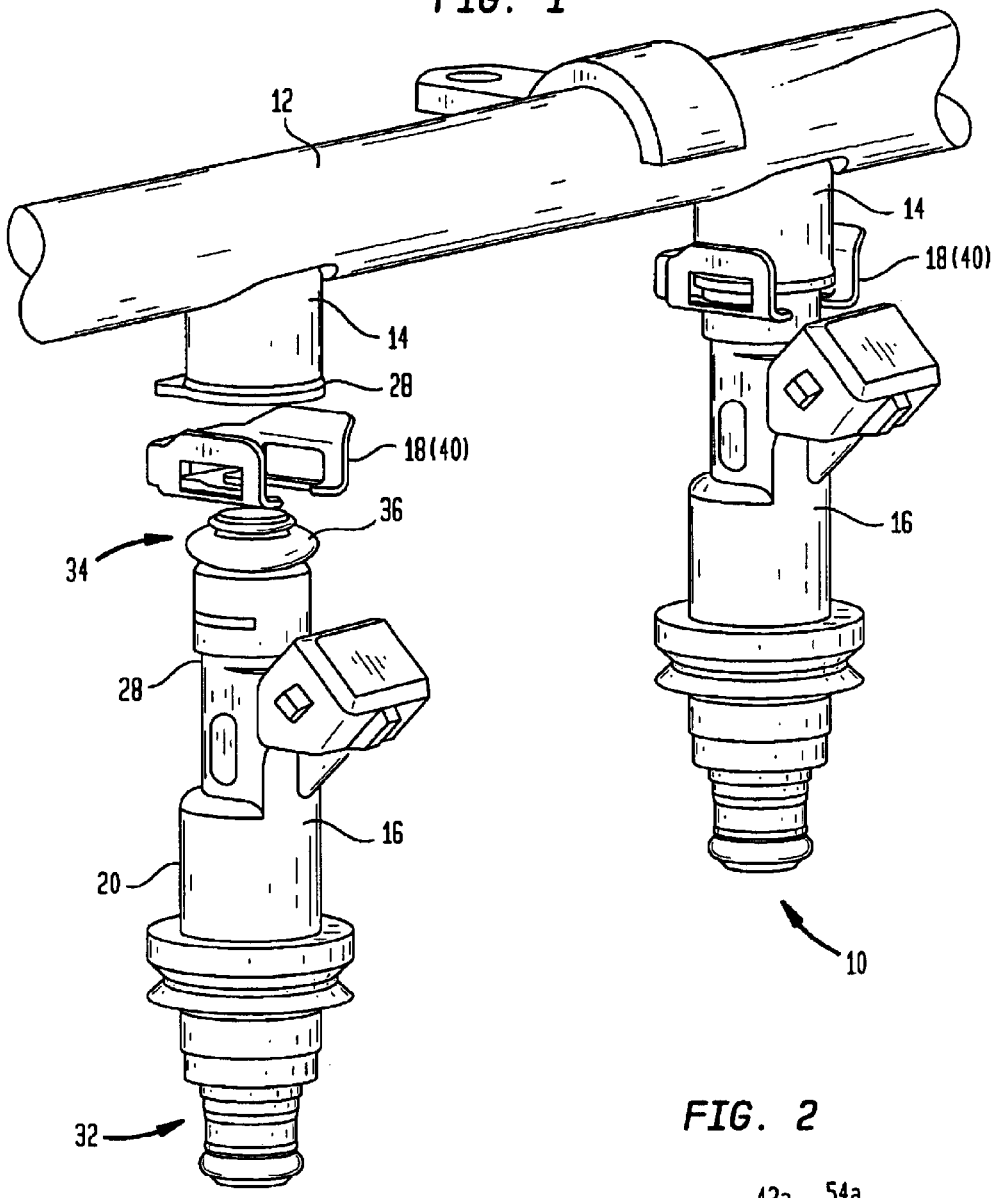
FIG. 1 is a perspective view of the mounting arrangement of the present invention.
Figure 2:
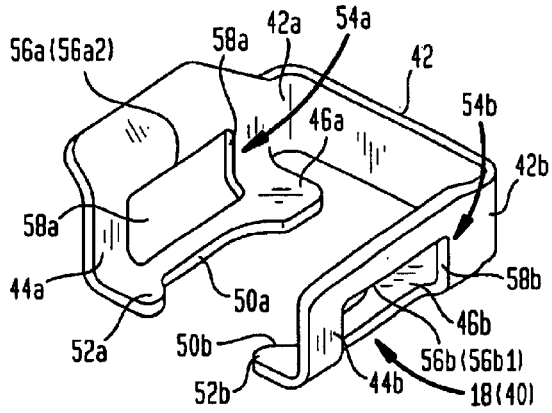
FIG. 2 is a perspective view of the fastener of the mounting arrangement of the present invention shown in FIG. 1.

FIG. 1 illustrates the mounting arrangement 10 of the present invention. The mounting arrangement 10 includes a fuel rail 12, fuel injector cups 14 connected to a fuel rail 12, a plurality fuel injectors 16, and a fastener 18 for each fuel injector 16.

Figure 3:
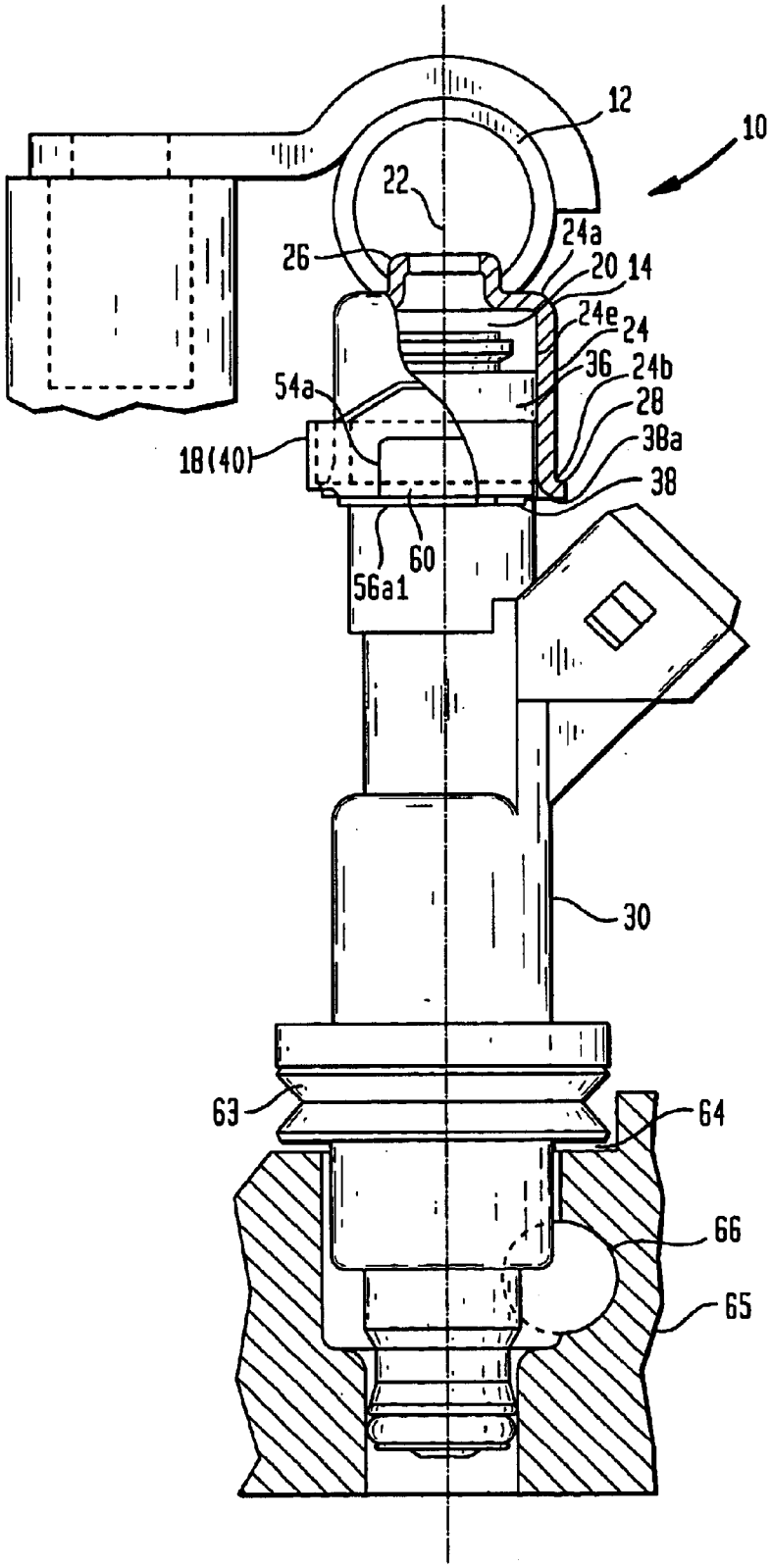
FIG. 3 is a partial cross-sectional view of the mounting arrangement of the present invention proximate an air induction device in a non-operative position.
Figure 4:
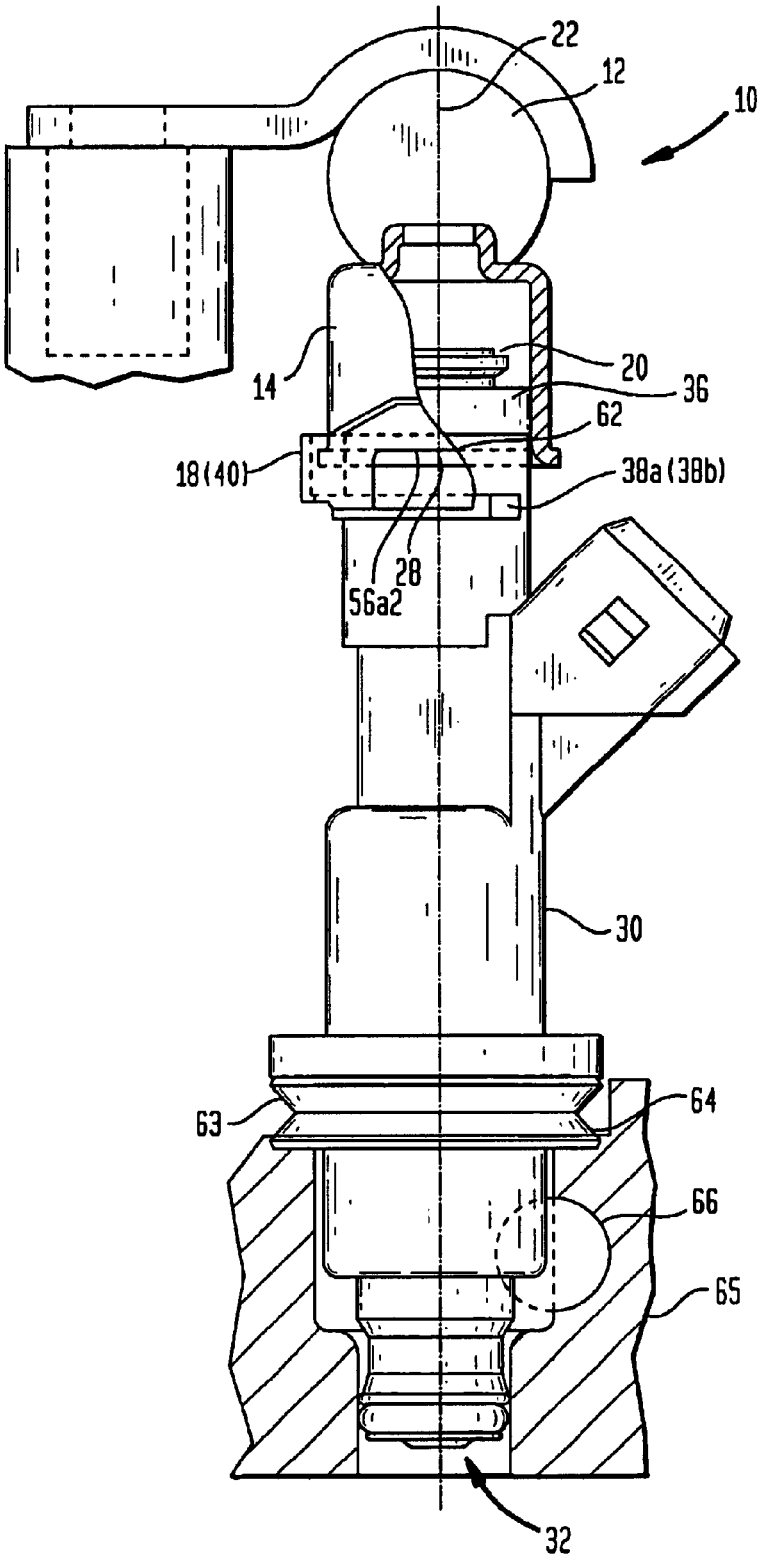
FIG. 4 is a partial cross-sectional view of the mounting arrangement of the present invention proximate an air induction device in an operative position.

Each of the fuel injector cups 14 has a fuel communication area 20 defining a longitudinal axis 22, illustrated in FIGS. 3 and 4. The fuel injector cup is a cylindrical tube 24. The cylindrical tube 24 is formed from stamped metal. A fuel rail mounting section 26 is located at a first end 24*a* of the cylindrical tube 24 that mounts the fuel injector cup 14 to the fuel rail 12.

The fuel rail mounting section 26 is, preferably, brazed to the fuel rail 12, which is also metal. A retaining surface is located at a second end 24*b* of the cylindrical tube 24. The retaining surface, preferably, comprises a lip 28 extending away from the longitudinal axis 22.

Each of the fuel injectors 16 includes a housing 30 having a fuel metering end 32 and a fuel inlet end 34. The fuel inlet end 32 is exposed to the communication area 20. An O-ring 36 is positioned on the housing 30 proximate the fuel inlet end 34. The O-ring 36 forms a fuel tight seal with an inner surface 24*c* of the cylindrical tube 24 of the fuel injector cup 14. The housing 30 of the fuel injector 16 is provided with a retention groove. In the preferred embodiment of the invention, the retention groove is a channel 38 that partially encircles the housing 30 of the fuel injector 16. The channel includes a first end 38*a* and a second end 38*b*.

Each fastener 18 secures a fuel injector 16 to a fuel injector cup 14 and allows the fuel injector 16 to reciprocate along the longitudinal axis 22 of the fuel injector cup 14. The fastener 18, preferably, is a stamped metal spring dip. The clip 40 has a wall 42 and a pair of legs 44, 46 projecting from the wall. The pair of legs 44*a*, 44*b* straddles both the fuel injector cup 14 and the fuel injector 16.

The wall 42 has a first end 42*a* and a second end 42*b*. The pair of legs includes a first leg 44*a* and a second leg 44*b*. The first leg 44*a* projects from the first end 42*a* of the wall 42. The first leg including a first tab 46*a* and a first window 48*a*. The second leg 44*b* projects from the second end 42*b* of the wall 42. The second leg 46*b* includes a second tab 46*b*, and a second window 48*b*. The first leg 44*a* and the second leg 44*b* are substantially parallel.

Each of the first tab 46*a* and the second tab 46*b* has a mating surface 50*a*, 50*b* that engages the retention groove of the fuel injector housing. In the preferred embodiment of the invention, each of the tabs 46*a*, 46*b* has a mating surface 50*a*, 50*b* that corresponds to the channel 38 that serves the retention groove in the fuel injector housing 30. Each tab includes a stop 52*a*, 52*b* that abuts the first end 38*a* and the second end 38*b* of the channel 38, respectively, to constrain relative rotation between the fuel injector 16 and the fuel injector cup 14.

Each of the first window 48*a* and the second window 48*b* has a substantially similar frame 54*a*, 54*b* that engages the retention surface of the fuel injector cup. In the preferred embodiment of the invention, the frame 54*a*, 54*b* of each the first window 48*a* and the second window 48*b* is adapted to engage the lip 28 of the fuel injector cup 14, which serves as the retention surface. Each of the frames 54*a*, 54*b* has a pair of landing edges 56*a* (56*a*1, 56*a*2), 56*b* (56*b*1, 56*b*2) extending along the corresponding leg 44*a*, 44*b*.

The frame 54*a*, 54*b* of each of the legs 44*a*, 44*b* further includes a pair of side edges 58*a*, 58*b* between the landing edges 56*a*, 56*b* so that the frame 54*a*, 54*b* has a substantially rectangular configuration. Although a substantially rectangular configuration is used for the frame, it is to be understood that other configurations, such as an oval, could be employed as long as the employed configuration includes a pair of landing edges. Each of the pair of side edges 58*a*, 58*b* between the landing edges 56*a*, 56*b* has a length approximately half the length of one of the pair of landing edges 56*a*, 56*b*.

The pair of landing edges 56*a*, 56*b* on each of the frames 54*a*, 54*b* are spaced so that engagement of one of the landing edges of the pair of landing edges with the lip 28 of the fuel injector cup 14 is exclusive of engagement of the lip 28 of the fuel injector cup 14 with the other of the landing edges of the pair of landing edges.

For example, as shown in FIG. 3, when the fuel injector 16 is located at a first position 60 along the longitudinal axis 22, the lip 28 of the fuel injector cup 14 engages one of the pair of landing edges 56*a*1, 56*b*1 provided on each of the frames 54*a*, 54*b*. The landing edge 56*a*1 56*ba* furthest from the fuel rail 12. Alternatively, as shown in FIG. 4, when the fuel injector 16 is located at a second position 62 along the longitudinal axis 22, the lip 28 of the fuel injector cup 14 engages the other landing edge 56*a*2, 56*b*2 of the pair of landing edges 56*a*, 56*b*. The landing edge 56*a*2, 56*b*2 closest to the fuel rail.

The fuel injector 16 is located at the second position 62 along the longitudinal axis 22, from an axial load created by an applied fuel pressure. When in the second position 62, the fuel injector 16 applies the appropriate sealing load to a face seal 63 on the metering end 32 of the fuel injector 16 so that the face seal 63 mates with an aperture 64 in an air induction device 65. The air induction device, preferably, comprises a manifold with an air assist passage 66. The manifold includes a head pocket that serves as the aperture.

Prior to installation of the mounting assembly in a vehicle proximate an air induction device, the fuel injector 16 can reciprocate along the longitudinal axis 22, such that the lip 28 of the fuel injector cup 14 engages either of the landing edges 56*a*1, and 56*b*1, or 56*a*2, and 56*b*2 of the pair of landing edges 56*a,* 56*b*. Although the fuel injector 16 is free to move along the longitudinal axis, the fuel injector 16 remains secured to the fuel injector cup 14 due to the engagement of the first tab 46*a* and the second tab 46*b* with the channel 38 of the fuel injector housing 30.

The mounting arrangement 10 comprises a production assembly having the clip 40 installed by an automated process. For implementation of the automated clip installation process, the clip 40 is manually installed onto the fuel injector housing 30 so that the first tab 46*a* and the second tab 46*b* engage the channel 38. After the clips 40 are installed on the fuel injectors 16, the fuel injectors 16 are placed into pockets attached to air cylinders. The number of pockets of the air cylinder corresponds to the number of fuel injector cups 14 located on the fuel rail 12. The fuel rail 12 is lubricated and clamped to a fixture at a fuel injector insertion station.

Once the fuel rail 12 and fuel injectors 16 are in place, the air cylinders are actuated to push the fuel injectors 16 by their associated clip 40 into the fuel injector cups on the fuel rail 12. During automated installation, the clip 40 springs open and stretches over the lip 28 of the fuel injector cup 14, and snaps closed as the frame 54*a,* 54*b* of the window 48*a,* 48*b* passes over the lip 28 of the fuel injector cup 14. After the clip 40 is closed, the air cylinders retract while pulling on the clips 40 to ensure that the clips 40 have been installed properly. That is, the first frame 54*a* and the second frame 54*b* have engaged the lip 28 of the fuel injector cup 14.

Then the fuel rail is situated such that the fuel injectors are allowed to hang freely and the assembly is subjected to production assembly testing. This testing also verifies that the clip has fully engaged both the fuel injector and the fuel injector cup. If the clip was not properly installed, the clip would be thrown off the production assembly during testing, and the assembly would fail the appropriate production assembly test.

The production assembly is capable of satisfying at least an appropriate assembly integrity test and environmental vibration test. The assembly integrity test includes: (1) an air leakage test in which the production assembly must have an air leakage rate of no greater than 2.5 cc/min when the production assembly is pressurized to no greater than 600 kPa; and (2) a liquid immersion test in which the production assembly when at a stable pressure of no greater than 500 kPa and submerged in a test fluid for 30 seconds no bubbles appear in the test fluid.

The environmental vibration test includes, while vibrating the production assembly for a minimum of 15 hours in a longitudinal, lateral, and vertical direction at varying frequencies no greater than 600 Hz sinusoidal, subjecting the production assembly to at least: (1) a thermal cycle test over a range of approximately −40 to 140° C.; and (2) a pressure cycle test of at least 30,000 cycles over a range of approximately 0 to 1500 kPa.

The present invention also includes a method of mounting the fuel injector to the fuel injector cup on a fuel rail so that the fuel injector is secured to the fuel injector cup and the fuel injector can be positioned along a longitudinal axis defined by the fuel injector cup. The method is achieved by providing a fuel rail with at least one fuel injector cup, the at least one fuel injector cup including a retaining surface; locating at least one fuel injector proximate the at least one fuel injector cap, the at least one fuel injector having a housing with a retention groove; and securing the at least one fuel injector to the at least one fuel injector cup with a fastener that engages both the retention surface of the fuel injector cup and the retention groove in the housing of the fuel injector.

The method further includes installing the clip with an automated process so that at least one fuel rail, and at least one fuel injector, and the clip comprise a production assembly capable of satisfying at least an appropriate assembly integrity test and environmental vibration test.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A mounting arrangement, comprising:

a fuel rail;

a fuel injector cup connected to the fuel rail, the fuel injector cup having a fuel communication area defining a longitudinal axis, a fuel rail mounting section, and a retaining surface;

a fuel injector including a fuel metering end and a fuel outlet end, the fuel inlet end being exposed to the communication area; and a fastener that (1) allows the fuel injector to reciprocate along the longitudinal axis of the fuel injector cup and to limit reciprocation of the fuel injector along the longitudinal axis in a direction toward the fuel injector cup and away from the fuel injector cup, the fastener having a wall and a pair of legs projecting from the wall, the pair of legs straddling both the fuel injector cup and fuel injector, the legs and wall each having a respective length along the longitudinal axis, the length of the wall being less than the length of each leg, and (2) secures the fuel injector to the fuel injector cup during an environmental vibration test that includes, while vibrating the mounting arrangement for a minimum of 15 hours in a longitudinal, lateral, and vertical direction at varying frequencies no greater than 600 Hz sinusoidal, subjecting the mounting arrangement to at least: (1) a thermal cycle test over a range of approximately −40 to 140° C.; and (2) a pressure cycle test of at least 30,000 cycles over a range of approximately 0 to 1500 kPa.

2. The mounting arrangement of claim 1, wherein the fuel injector cup comprises a cylindrical tube, the fuel rail mounting section being located at a first end of the tube, the retaining surface being located at a second end of the tube; and wherein the fuel injector comprises a housing having a retention groove.

3. The mounting arrangement of claim 2, wherein each leg of the fastener comprises a tab and a window, the tab having a mating surface that engages the retention groove of the fuel injector housing, the window having a frame that engages the retaining surface of the fuel injector cup.

4. The mounting arrangement of claim 3, wherein the retaining surface comprises a lip located at the second end of cylindrical tube, the lip extending away from the longitudinal axis;

wherein the frame comprises a pair of landing edges configure so that, when the fuel injector is located at a first position along the longitudinal axis, the lip of the fuel injector cup engages one of the landing edges, and when the fuel injector is located at a second position along the longitudinal axis, the lip of the fuel injector cup engages the other of the pair of landing edges.

5. The mounting arrangement of claim 4, wherein the retention groove comprises a channel that partially encircles the housing of the fuel injector, the channel including a first end and a second end;

wherein each of the tabs on each of the legs includes a stop that abuts the first end and the second end of the channel, respectively, to constrain relative rotation between the fuel injector and the fuel injector cup.

6. The mounting arrangement of claim 5, further comprising an air induction device having an aperture, the metering end of the fuel injector comprising a face seal that mates with the aperture when the fuel injector is located at one of the first position and the second position along the longitudinal axis.

7. The mounting arrangement of claim 6, wherein the mounting arrangement comprises a production assembly having the fastener installed by an automated process, the production assembly being capable of satisfying at least an appropriate assembly integrity test and environmental vibration test.

8. A mounting arrangement, comprising:

a fuel rail;

a plurality of fuel injector cups connected to the fuel rail, each of the fuel injector cups including a cylindrical tube defining a longitudinal axis, a fuel rail mounting section disposed at a first end of the tube, and a lip at a second end of the tube;

a plurality of fuel injectors, each fuel injector corresponding to one of the plurality of fuel injector cups, each fuel injector having a housing including a fuel metering end, a fuel inlet end, and a retention groove, the fuel inlet end of the fuel injector being disposed within the cylindrical tube of the fuel injection cup; and a clip that engages both the lip of the fuel injector cup and the retention groove in the housing of the fuel injector to secure the fuel injector to the fuel injector cup and allow the fuel injector to reciprocate along the longitudinal axis extending through the cylindrical tube of the fuel injector cup, the clip limiting reciprocation of the fuel injector along the longitudinal axis in a direction toward the fuel injector cup and away from the fuel injector cup, the clip having a wall and a pair of legs projecting from the wall, the pair of legs straddling both the fuel injector cup and fuel injector, the legs and wall each consisting of a respective length along the longitudinal axis, the longest length of the entire wall being less than the length of each leg, the leg including a tab extending generally orthogonal to the leg, the leg defining a window having at least one landing edge contiguous to the tab.

9. The mounting arrangement of claim 8, wherein the tab comprises a mating surface that engages the retention groove in the housing of the fuel injector, the window having a frame that engages the lip of the fuel injector cup, the frame having a pair of landing edges extending along the corresponding leg, the pair of landing edges on the frame configured so that, when the injector is located at a first position along the longitudinal axis, the lip of the fuel injector cup engages one of the landing edges, and when the injector is located at a second position along the longitudinal axis, the lip of the fuel injector cup engages the other of the pair of landing edges.

10. The mounting arrangement of claim 9, wherein the mounting arrangement comprises a production assembly having the clip installed by an automated process;

wherein the production assembly is capable of satisfying at least an appropriate assembly integrity test and environmental vibration test.

11. An assembly, comprising:

a fuel rail;

a plurality of fuel injector cups connected to the fuel rail, each of the fuel injector cups including a cylindrical tube defining a longitudinal axis, a fuel rail mounting section disposed at a first end of the tube, and a lip at a second end of the tube;

a plurality of fuel injectors, each fuel injector corresponding to one of the plurality of fuel injector cups, each fuel injector having a housing including a fuel metering end, a fuel inlet end, and a retention groove, the fuel inlet end of the fuel injector being disposed within the cylindrical tube of the fuel injection cup; and a clip that engages both the lip of the fuel injector cup and the retention groove in the housing of the fuel injector to secure the fuel injector to the fuel injector cup and allow the fuel injector to reciprocate along the longitudinal axis extending through the cylindrical tube of the fuel injector cup, the clip limiting reciprocation of the fuel injector along the longitudinal axis in a direction toward the fuel injector cup and away from the fuel injector cup, the clip having a wall and a pair of legs projecting from the wall, the pair of legs straddling both the fuel injector cup and fuel injector, the legs and wall each having a respective length along the longitudinal axis, the length of the wall being less than the length of each leg;

wherein the clip comprises a wall and a pair of legs projecting from the wall, the pair of legs straddling both the fuel injector cup and fuel injector, each leg having with a tab and a widow, the tab having a mating surface that engages the retention groove in the housing of the fuel injector, the window having a frame that engages the lip of the fuel injector cup, the frame having a pair of landing edges extending along the corresponding leg, the pair of landing edges on the frame configured so that, when the injector is located at a first position along the longitudinal axis, the lip of the fuel injector cup engages one of the landing edges, and when the injector is located at a second position along the longitudinal axis, the lip of the fuel injector cup engages the other of the pair of landing edges;

wherein the clip is installed by an automated process;

wherein the assembly is capable of satisfying at least an appropriate assembly integrity test and environmental vibration test;

wherein the assembly integrity test includes: (1) an air leakage test in which the production assembly must have an air leakage rate of no greater than 2.5 cc/min when the production assembly is pressurized to no greater than 600 kPa; and (2) a liquid immersion test in which the production assembly when at a stable pressure of no greater than 500 kPa and submerged in a test fluid for 30 seconds no bubbles appear in the test fluid; and wherein the environmental vibration test includes, while vibrating the production assembly for a minimum of 15 hours in a longitudinal, lateral, and vertical direction at varying frequencies no greater than 600 Hz sinusoidal, subjecting the production assembly to at least: (1) a thermal cycle test over a range of approximately −40 to 140° C.; and (2) a pressure cycle test of at least 30,000 cycles over a range of approximately 0 to 1500 kPa.

12. A clip for securing a fuel injector to a fuel injector cup on a fuel rail, the fuel injector having a housing disposed along a longitudinal axis with a retention groove, and the fuel injector cup having a lip, the clip comprising:

a wall having a first end and a second end, the wall having a length disposed along the longitudinal axis;

a first leg projecting from the first end of the wall, the first leg including a first tab and a first window, the first leg having a length disposed along the longitudinal axis; and a second leg projecting from the second end of the wall, the first leg and the second leg being substantially parallel, the second leg including a second tab and a second window, the second leg having a length disposed along the longitudinal axis;

wherein the length of the wall is less than the length of the first or second legs;

wherein the first tab and the second tab have a corresponding mating surface configuration adapted to engage the retention groove in the housing of the fuel injector;

wherein the first window and the second window each have a substantially similar frame adapted to engage the lip of the fuel injector cup, each of the frames having a pair of landing edges extending along the corresponding leg, the pair of landing edges on each of the frames being spaced so that engagement of one of the landing edges with the lip of the fuel injector cup is exclusive of engagement of the lip of the fuel injector cup with the other of the landing edges so that the one of the landing edges limits the reciprocation of the fuel injector along the longitudinal axis in the direction toward the fuel injector cup and the other one of the landing edges limits reciprocation of the fuel injector along the longitudinal axis in the direction away from the fuel injector cup;

wherein the frame of each of the legs further includes a pair of side edges between the landing edges so that the frame has a substantially rectangular configuration; and wherein the frame of each of the legs further includes a pair of side edges between the landing edges, each of the side edges having a length approximately half the length of one of the landing edges.

13. A method of mounting a fuel injector to a fuel injector cup on a fuel rail so that the fuel injector is secured to the fuel injector cup and the fuel injector can be positioned along a longitudinal axis defined by the fuel injector cup, the method comprising:

providing a fuel rail with at least one fuel injector cup, the at least one fuel injector cup including a retaining surface;

locating at least one fuel injector proximate the at least one fuel injector cup, the at least one fuel injector having a housing with a retention groove; and securing the at least one fuel injector to the at least one fuel injector cup with a fastener that engages both the retention surface of the fuel injector cup and the retention groove in the housing of the fuel injector, the fastener limiting reciprocation of the fuel injector along the longitudinal axis in a direction toward the fuel injector cup and away from the fuel injector cup, the fastener having a wall and a pair of legs projecting from the wall, the pair of legs straddling both the fuel injector cup and fuel injector, the wall and each leg consisting of a length disposed along the longitudinal axis, the longest length of the entire wall being less than the length of each leg, the leg including a tab extending generally orthogonal to the leg, the leg defining a window having at least one landing edge contiguous to the tab.

14. The method of claim 13, further comprising:

providing a lip on the fuel injector cup as the retaining surface and a channel partial encircling the housing of the fuel injector as the retaining groove; and provide a metal clip as the fastener, the clip including the tab having a mating surface that engages the channel in the housing of the fuel injector, the window having a frame that engages the lip of the fuel injector cup, the frame having a pair of landing edges extending along the corresponding leg, the pair of landing edges on the frame configured so that, when the fuel injector is located at a first position along the longitudinal axis, the lip of the fuel injector cup engages one of the landing edges, and when the fuel injector is located at a second position along the longitudinal axis, the lip of the fuel injector cup engages the other of the pair of landing edges.

15. The method of claim 14, further comprising:

installing the clip with an automated process so that the at least one fuel rail, the at least one fuel injector, and the clip comprise a production assembly capable of satisfying at least an appropriate assembly integrity test and environmental vibration test.

16. The method of claim 15, further comprising:

providing an air induction device having an aperture so that a face seal on a metering end of the fuel injector mates with the aperture when the fuel injector is located at one of the first position and the second position along the longitudinal axis.

* * * * *